US006827128B2

(12) United States Patent
Philpott et al.

(10) Patent No.: US 6,827,128 B2
(45) Date of Patent: Dec. 7, 2004

(54) FLEXIBLE MICROCHANNEL HEAT EXCHANGER

(75) Inventors: Michael I. Philpott, Seymour, IL (US); Mark A. Shannon, Champaign, FL (US); John C. Selby, Urbana, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 8 days.

(21) Appl. No.: 10/151,703

(22) Filed: May 20, 2002

(65) Prior Publication Data

US 2003/0213580 A1 Nov. 20, 2003

(51) Int. Cl.[7] ..... F28F 7/00

(52) U.S. Cl. ..... 165/46; 165/170; 29/890.032

(58) Field of Search ..... 165/80.4, 170, 165/46, 185; 29/890.032; 428/188, 172; 126/624, 626, 546

(56) References Cited

U.S. PATENT DOCUMENTS

| | | | | |
|---|---|---|---|---|
| 4,524,757 A | * | 6/1985 | Buckley | 126/624 |
| 5,083,194 A | | 1/1992 | Bartilson | |
| 5,099,311 A | | 3/1992 | Bonde et al. | |
| 5,166,775 A | | 11/1992 | Bartilson | |
| 5,193,611 A | * | 3/1993 | Hesselgreaves | 165/165 |
| 5,195,240 A | * | 3/1993 | Shuster et al. | 29/890.039 |
| 5,245,693 A | * | 9/1993 | Ford et al. | 392/470 |
| 5,381,510 A | * | 1/1995 | Ford et al. | 392/470 |
| 5,457,956 A | | 10/1995 | Bowman et al. | |
| 5,878,807 A | * | 3/1999 | Takahashi | 165/46 |
| 6,059,024 A | * | 5/2000 | Ramshaw et al. | 165/166 |
| 6,129,973 A | * | 10/2000 | Martin et al. | 428/166 |
| 6,148,635 A | | 11/2000 | Beebe et al. | |
| 6,529,377 B1 | * | 3/2003 | Nelson et al. | 361/699 |

FOREIGN PATENT DOCUMENTS

| | | | | |
|---|---|---|---|---|
| JP | 05164492 A | * | 6/1993 | 165/170 |
| WO | WO 98/00869 | | 1/1998 | |

OTHER PUBLICATIONS

Van de Pol, H. Van Lintel, M. Elwenspoek, J. Fluitman, "A Thermopneumatic Micropump Based on Micro–Engineering Techniques", *Sensors and Actuators*, Proceedings of the 5th International Conference on Solid–State Sensors and Actuators and Eurosensors III, Jun. 25–30, 1989, Montreux, Switzerland, vol. A21, 1990.

Cabuz, "Mesoscopic Pumps Based on Bidirectional, Electrostatically Activated, Diaphragm Arrays", Honeywell Technology Center, presented at DARPA Principal Investigations Meeting, Annapolis, Oct. 20–21, 1998.

Drost, M. Friedrich, C. Shepard, C. Martin, B. Hanna, D. Hatley, J. Martin, K. Brooks, "Mesoscopic Heat Actuated Heat Pump Project", presented at DARPA Principal Investigators Meeting Annapolis, Oct. 20–21, 1998.

* cited by examiner

*Primary Examiner*—Terrell McKinnon
(74) *Attorney, Agent, or Firm*—Greer, Burns & Crain, Ltd.

(57) ABSTRACT

A flexible mesoscopic heat exchanger is provided by the invention. The heat exchanger of the invention includes uniform microchannels for fluid flow. Separate header and channel layers include microchannels for fluid flow and heat exchange. A layered structure with channels aligned in multiple orientations in the layers permits the use of a flexible material without channel sagging and provides uniform flows. In a preferred embodiment, layers are heat sealed, e.g., by a preferred lamination fabrication process.

11 Claims, 4 Drawing Sheets

FLEXIBLE MICROCHANNEL HEAT EXCHANGER

STATEMENT OF GOVERNMENT INTEREST

This invention was made with government support under Contract Number DABT63-97-C-0069 awarded by the Defense Advanced Research Project Agency (DARPA). The government has certain rights in this invention.

FIELD OF THE INVENTION

A field of the invention is heating and cooling. An additional field of the invention is mesoscopic devices.

BACKGROUND OF THE INVENTION

Small scale active heating and cooling devices hold tremendous potential. Potential uses are limited only by the decision as to whether a device, process, or application would benefit from active heating or cooling. Implementation of networked, low-power mesoscopic devices offers obvious advantages compared to traditional active heating and cooling. Practical issues remain in the way of widespread implementation and use of such devices, however. In addition to active heating and cooling devices, e.g., heat pumps, there are additional examples of mesoscale systems that hold promise for a wide range of practical applications. Examples of such mesoscale systems include combustors and evaporators, heat exchangers, and chemical and biological systems.

Mesoscale devices such as these can be defined as ones where the critical physical length scale is on the same order as the governing phenomenological length scale, or ones with critical dimensions that span the microscale to the normal scale ($\mu$m<length scale<cm). These large differences in scale pose several challenges in manufacturing. Mesoscopic heat exchangers are needed for a number of applications requiring high heat flux (>1000 W/m$^2$) across thin cross-sections, without incurring excessive pressure losses due to fluid flow in small channels. Enhancement in heat transfer occurs when the effective cross-sectional thickness of a mesoscale heat exchanger matches the thickness over which heat is transferred to the working fluids.

Exemplary potential practical uses of heat exchangers include laptop computer cooling, car seat heating and cooling, airfoil skin heat exchangers, micro-chemical reactors, and compact heat exchangers among others. Another exemplary practical application is the temperature control of clothing. While time is likely to bring the technology to clothing in general, a likely initial application is to chemical and biological warfare protective suits for military personnel operating in extremely hazardous environments. Integrated mesoscopic cooler circuits (IMCC) have been developed by some of the present inventors, and are described, for example in Beebe et al., U.S. Pat. No. 6,148,635, which is incorporated by reference herein. Also see, Shannon, et al., "Integrated Mesoscopic Cooler Circuits (IMCCs)." Proceedings of the ASME, Advanced Energy System Division 39, Symposium on Miniature and Mesoscopic Energy Conversion Devices (1999), p. 75–82.

Others have endeavored to design, fabricate, and mass-produce microchannel (below about 1 mm diameter) heat exchangers for microelectronics cooling and the refrigeration industry. See, P. M. Martin et al, "Microchannel Heat Exchangers for Advanced Climate Control," Proceedings of the SPIE 2639, (1995), p. 82–88. Delphi Automotive Systems and Modine Manufacturing Company have produced some commercially available mesoscopic heat exchangers made from extruded metals, such as aluminum. Such exchangers are capable of holding high internal pressures and can support large heat fluxes, but typically measure between 0.5 to 1 mm thick, and are not flexible after forming.

Microfabricated thin-film heat exchangers with microchannels 1 mm wide×30 $\mu$m high, made from photosensitive polyimide layers have been reported. Mangriotis, M. D. et al., "Flexible Microfluidic Polyimide Channels," Transducers 99, The 10th International Conference on Solid-State Sensors and Actuators, Digest of Technical Papers, Sendai, Japan, Jun. 7–10, (1999) p. 772–775. Polyimide was chosen because it is a commercially available high-performance polymer, renowned for its excellent thermal stability, mechanical toughness, high strength, and superior chemical resistance. Fabrication of these heat exchangers utilized batch-mode semiconductor processing of multiple spin-coated layers of DuPont (now HD MicroSystems) PI-2721 polyimide to define specific fluid and vent channel geometries, followed by solvent bonding of a 75 mm thick Kapton HN film to seal the device. See, Glasgow, I. K. et al., "Design Rules for Polyimide Solvent Bonding," Sensors and Materials 11.5 (1999) p. 269–278.

Even with properly designed vent channel spacing, vapor evolution inherent to the solvent bonding technique can locally degrade the interfacial seal between the microchannels and the Kapton HN film. Thus, large area heat exchangers demonstrated poor structural reliability and thus low fabrication yields. Sealed devices inevitably suffered from very high pressure losses (>100 kPa) over flow lengths of 20 mm, caused by the 30 micron interior channel height. To minimize pressure losses over long flow paths, increased channel heights are required. However, achieving 50 to 150 $\mu$m high channels by using multiple spin-coated layers proved to be difficult to scale-up over large planar areas. These examples illustrate some of the difficulties faced in mesoscale device fabrication. Mesoscale devices with vastly different critical dimensions require fabrication methods that can simultaneously meet the tolerances required at both scales.

SUMMARY OF THE INVENTION

A flexible mesoscopic heat exchanger is provided by the invention. The heat exchanger of the invention includes uniform microchannels for fluid flow. Separate header and channel layers include microchannels for fluid flow and heat exchange. A layered structure with channels aligned in multiple orientations in the layers permits the use of a flexible material without channel sagging and provides for uniform fluid flows. In a preferred embodiment, layers are heat sealed, e.g., by a preferred lamination fabrication process.

DETAILED DESCRIPTION OF THE PREFERRED EMBODIMENTS

The invention concerns a mesoscopic multilayer structure with internal microchannels. The entire structure is flexible. A layered structure with channels aligned in multiple orientations in the layers permits the use of a flexible material without channel sagging. Flows are through separate manifold and channel layers. A fabrication method of the invention includes single layer patterning and multilayer lamination. Heat bonding avoids solvent bonding.

Figure 1:
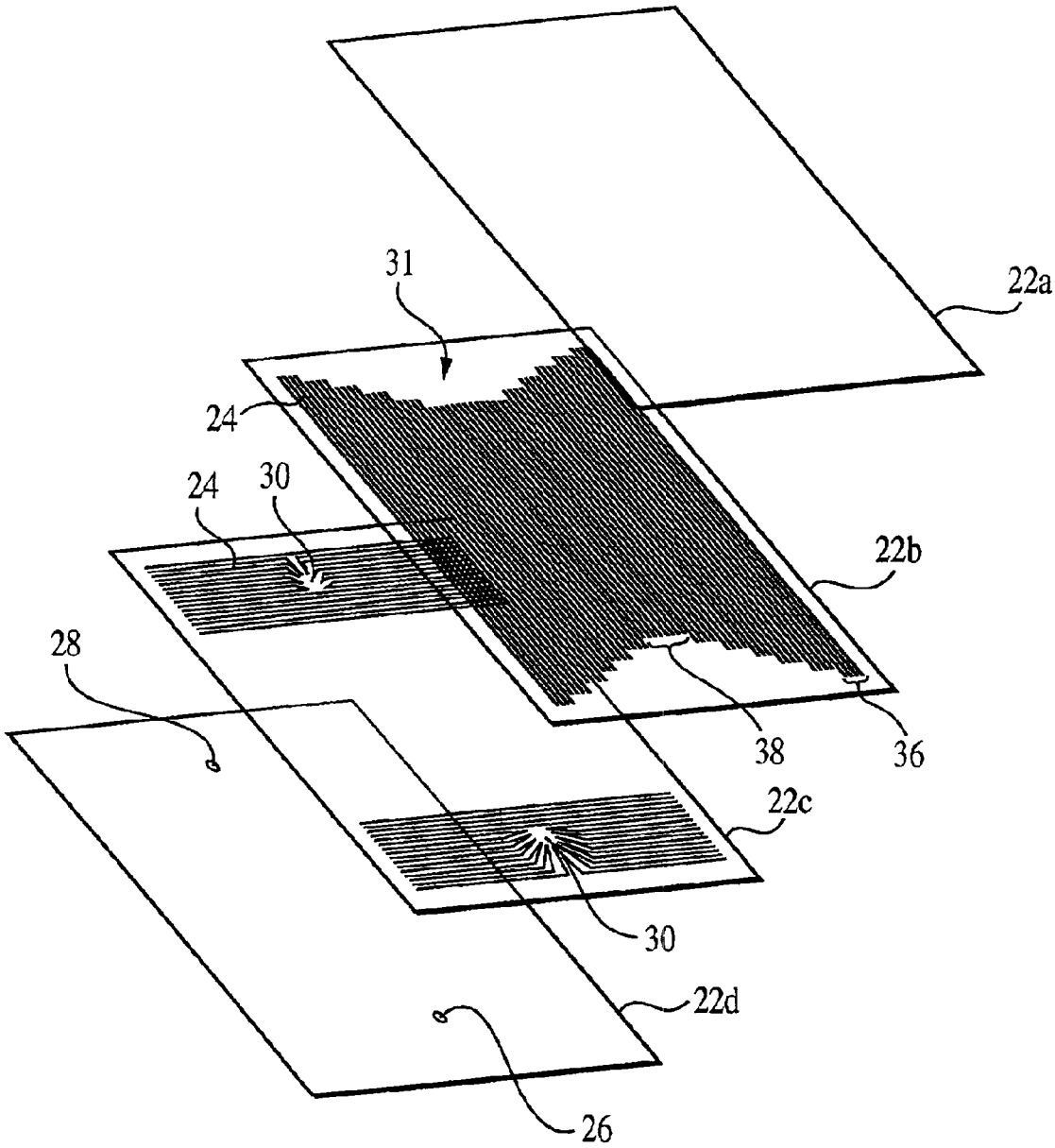
FIG. 1 is an exploded schematic view of a preferred embodiment mesoscopic heat exchanger.

Referring now to FIG. 1, a preferred embodiment heat exchanger includes layers 22*a*, 22*b*, 22*c* and 22*d*. Each of these layers is formed of flexible heat-sealable polyimide. Layers 22*b* and 22*c* include uniformly dimensioned (in width and height) microchannels 24. From device to device, dimensions of the channels may be selected to meet a particular performance parameters, but within each individual device, microchannels are highly uniform in width and height. Refrigerant or other fluid enters through an inlet hole 26 the device interface in layer 22*d*. The device interface layer 22*d* interfaces with another device that includes means for promoting flow of liquid through the heat exchanger. Layer 22*c* acts as a header, i.e., a layer for even distribution of refrigerant or heating fluid for heat transfer into the channel layer 22*b*. Heat transfer is with the cap layer 22*a* that seals in refrigerant by closing the top of channels 24 in the channel layer 22*b* and forms an outside surface of the heat exchanger. An opposite side of the header layer reaccepts refrigerant after heat transfer and creates a uniform flow back into an exit hole 28 of the device interface layer 22*d*.

Figure 2:
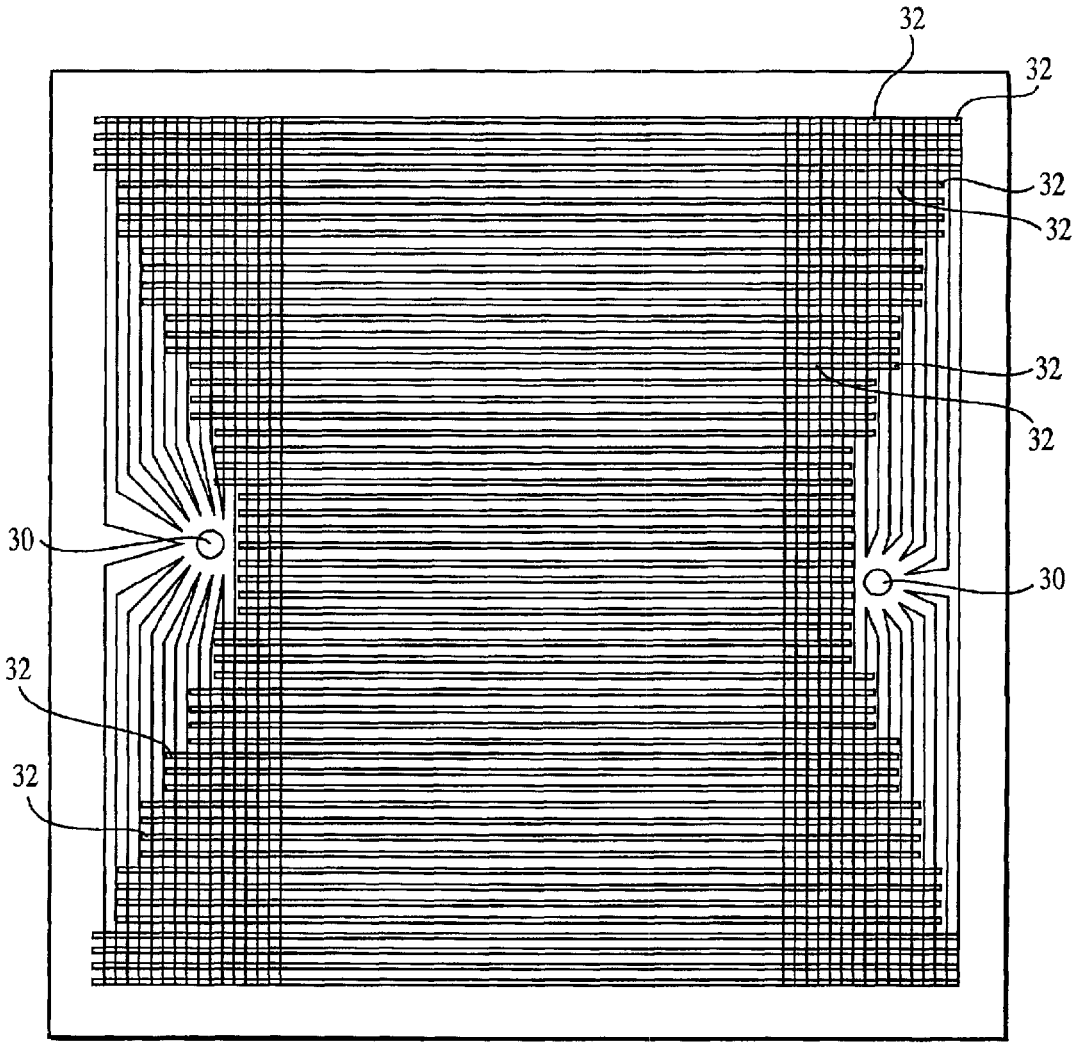
FIG. 2 is a schematic assembled view of the preferred embodiment mesoscopic heat exchanger.

The microchannels 24 in alternate layers, e.g., layers 22*b* and 22*c* are oriented differently to provide channel floors (the individual layers 22*b* and 22*c* only define, by themselves, channel walls), and add a structural integrity that avoids sagging of thin-walled and thin-floored microchannels in the completed assembly. In addition, the lengths of individual microchannels are patterned in a manner to establish uniform flows. In the preferred FIGS. 1 and 2 embodiment, for example, microchannels in layer 22*b* have different lengths that establish a shape. The center channels are gradually shorter to give the channels in the layer an overall hourglass like configuration. The waist 31 of the hourglass shape avoids channels over ports 30 in the layer 22*c* that communicate refrigerant into its channels from the intlet hole 26 and out from its channels into the outlet hole 28. In intersection areas 32 (see FIG. 2) where channels from the layers 22*b* and 22*c* overlap, and the different orientation provides rigidity that avoids channel sag under pressured conditions. Only a few of the many intersections 32 in FIG. 2 are labeled with reference numerals to keep the figure clear. Referring to FIG. 2, the shape also establishes the desirable uniform flows into channels. Uniform flows into and out of the exchanger avoid pockets of pressure build-up that can be destructive to the heat exchanger.

When manifold input area from ports 30 to each channel in the layer 22*b* is varied, with channels closest to the ports 30 having a minimum area and channels farthest from the ports 30 having a maximum area, refrigerant flow is optimized. The general star-burst manifold shape surrounding ports 30 is, along with the hourglass configuration in the channel layer 22*b*, therefore preferred to provide uniform flows. A set 36 of microchannels in the channel layer 22*b* furthest from the ports 30 intersects all of the microchannels in the header layer 22*c*, whereas the number of header microchannels intersected by microchannels in the channel layer 22*b* gradually decreases (by sets in the preferred channel layer 22*b*) with a set 38 of microchannels closest to the ports intersecting the fewest number of microchannels in the header layer 22*c*. The number of cross-over intersections 32 between the channels in header layer 22*c* and channel layer 22*b* controls the input area afforded each flow into a set of the microchannels in the channel layer 22*b*.

An additional point about the shaping is that the patterns make use of separate header flow layer 22*c* to enable fabrication by a lamination process. From a fabrication standpoint, the lamination process can only be utilized if each individually patterned layer represents a contiguous whole, with no independent or isolated solid geometries. Overlapping of geometrical material voids patterned in the individual layers during the lamination process creates a manufacturable internal geometry and defines channels when the individual layers 22*b* and 22*c* have a piano-wire style cut all the way through to define channel walls. This is achieved by the separate header 22*c* and channel 22*b* layers, resulting in three-dimensional, rather than two-dimensional, refrigerant flow paths.

In accordance with the preferred embodiment, layers 22*a*, 22*b*, 22*c* and 22*d* are formed from heat-sealable polyimide films. Lamination of a multilayer structure of mechanically patterned polyimide heat-sealable films was found to provide the most versatile fabrication process. It is critical to use heat sealed films, as contrasted with solvent bonded films. Exemplary heat-sealable polyimide films preferred for the invention are the Kapton® KJ and EKJ (DuPont) films. Other examples are Teflon® coated Kapton® FN heat-sealable films. Other heat-sealable polyimide films, including those to be developed, will also be suitable. In contrast to Teflon® coated Kapton® FN heat-sealable films, Kapton® KJ and EKJ (DuPont) are thermoplastic all-polyimide films designed as adhesive bonding sheets for high performance applications. The difference between KJ and EKJ films is the inclusion of a Kapton® E polyimide layer as the core of an EKJ film to enhance its mechanical properties. The enhanced properties are preferred.

The EKJ films for the cap 22*a* and inlet/outlet 22*d* layers prevented, due to their higher modulus and glass transition temperature, sagging of the spanning membrane sections of the microchannels and manifolds during the lamination cycle. Omission of the EKJ layers in attempts to use KJ for all four layers resulted in solid laminates with no internal geometry because of thermoplastic flow during the bonding process. Accordingly, heat sealable polyimide layers used for the outer layers must have a sufficiently high modulus and glass transition temperature to maintain solidity during the lamination process. Table 1 highlights a few selected properties of the preferred materials:

TABLE 1

| | KJ | EKJ |
|---|---|---|
| Glass Transition Temperature | 220° C. | 220° C. KJ > 340° C. E core |
| Tensile Strength | 20 ksi | 30 ksi |
| Modulus | 400 ksi | 700 ksi |
| Elongation | 150% | 70% |
| CTE | 60 ppm/° C. | 25 ppm/° C. |
| Moisture Content | 1.0% | 2.0% |

Channel and manifold heights are easily controlled by layer thickness. With single channel layer construction, microchannel heights of roughly 70 $\mu$m were achieved in experimental prototypes according to the FIGS. 1 and 2 embodiment.

Figure 3:
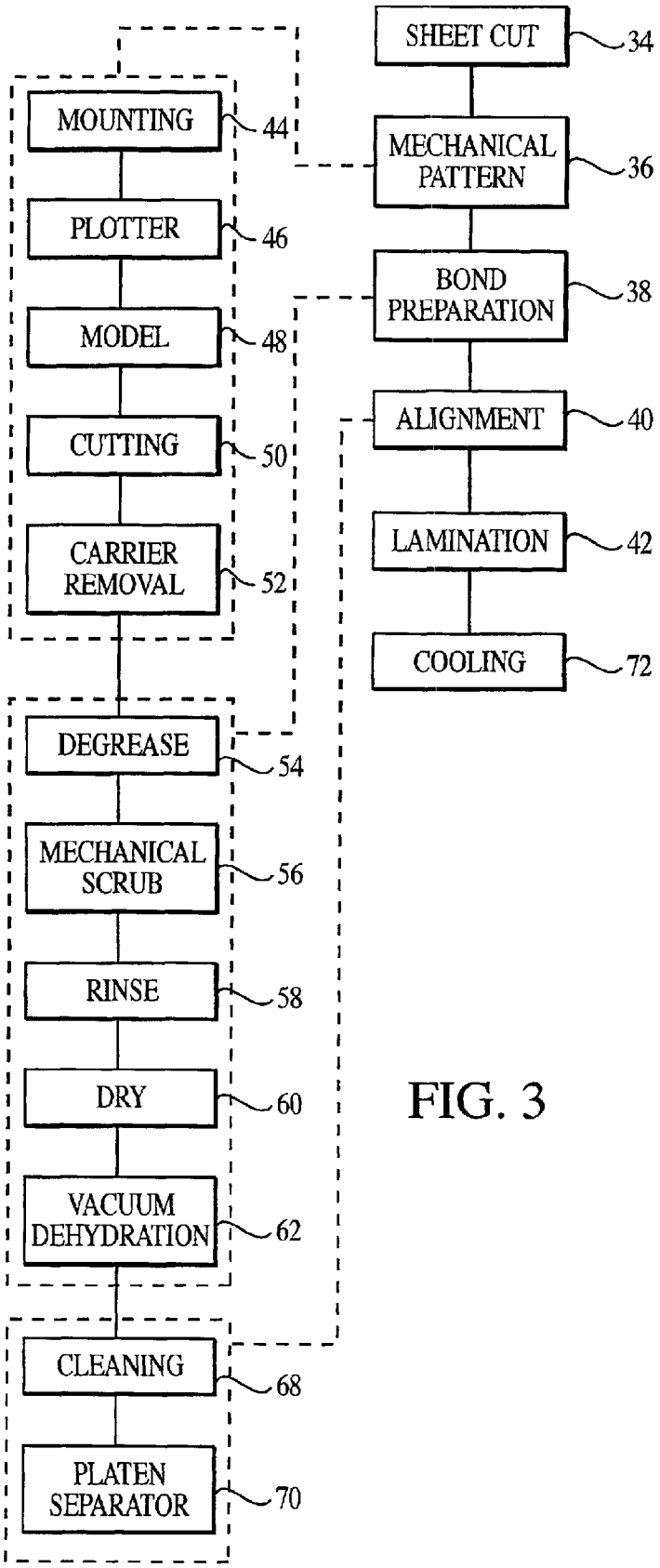
FIG. 3 is a block diagram illustrating a preferred fabrication process for a mesoscopic heat exchanger.

Referring now to FIG. 3, a block diagram illustrates the general steps for a preferred fabrication method of the invention. Heat-sealable polyimide sheets are cut to size (step 34). Mechanical patterning of the layers is conducted (step 36). A preferred technique is computer controlled knife cutting for the mechanical patterning. In practice, there are likely four process flows, one for each of the four layers 22*a*, 22*b*, 22*c*, 22*d*. Subsequent to patterning, the layers undergo bond preparation (step 38), e.g., solvent degreasing and a dehydration bake. Layers are aligned (step 40) and laminated (step 42) by a heat treatment, such as a vacuum hot press.

In a preferred technique for the mechanical patterning of step 36 used to form experimental prototype heat exchanges, layers were patterned using computer controlled knife cutting. In prototypes constructed according to the preferred FIGS. 1 and 2 embodiment, layers 22*a* and 22*d* were made from EKJ (50 $\mu$m thick) films, and layers 22*b* and 22*c* were made from KJ (75 $\mu$m thick) films. In practice of the invention, thicker films for layers 22*b* and 22*c* would be preferred to allow deeper microfluidic channels.

To begin the preferred patterning process, sheets of KJ and EKJ are sheet cut (step 34) into roughly 400 mm×400 mm areas. The patterning used a mounting (step 44) onto a carrier. In the experimental fabrication, paper-board with an adhesive backing was used as a carrier for the polyimide films during the patterning process. The depth of cut was set to approximately 80 $\mu$m so that the blade does not penetrate the paper-board carrier, ensuring that sectioned film areas remain attached to the carrier and do not project outward and interfere with the traveling blade. After initial manual alignment, the sheet is positioned into the grit-rolling cutting plotter (step 46) that automatically provides horizontal and vertical justification. Cutting proceeds according to a 3 dimensional modeling (step 48). A three-dimensional solid model controls the cutting process (step 50). The carrier is removed after cutting (step 52). With the use of a paper carrier, the carrier board may be removed, for example, by soaking in an acetone bath for a time to permit the acetone to diffuse through the paper board to the adhesive/polyimide interface, dissolving the adhesive backing. The patterned polyimide films "lift-off" the paper board. No peeling or stretching of the films is required for removing the carrier substrate, precluding any unwarranted straining of the individual layers and patterns.

The completed cutting process contaminates the polyimide layers. The bond preparation step 38 prepares the layers for lamination. Contaminated layers may not bond properly. A second acetone bath may be used for solvent degreasing (step 54). During the degreasing (step 54), mechanical scrubbing (step 56) may be used, e.g., with polyester-fiber cloths, to remove residual adhesive as well as other organic contaminants present on the film as received from the factory. Layers are rinsed (step 58), e.g., with an isopropanol bath, and blown dry (step 60), e.g., with nitrogen. After bond preparation, films should be handled with sterile equipment or, if by operators, with operators wearing powder-free latex or nitrile gloves. Surface cleanliness tends to dominate the mechanical and chemical strength of interlaminar bonds.

Test fabrications of prototype heat exchangers revealed that KJ and EKJ films, like most all polyimides, demonstrated a propensity to absorb water in ambient temperature and humidity environments. During the high-temperature lamination process, absorbed water volatized, aggregated, and formed voids at the layer interfaces, making it extremely difficult to bond large areas. Void formation is avoided by a vacuum dehydration bake (step 62) prior to lamination. In experiments, a 12 hour bake at a temperature of 150° C. and an ambient pressure of 0.1 KPa was used. The dehydration bake time and temperature schedule was not optimized, and thus shorter process times are thought to be possible. Much shorter times should be realized in a scaled up manufacturing process where the manufacturing environment and equipment conditions are controlled to avoid water absorption.

After cleaning and dehydration, patterned layers are ready for alignment and lamination. In separate experiments, it was discovered that KJ and EKJ films adhere to many metal surfaces during pressurized heat-sealing in a hot press. Lamination therefore makes use of a platen separator. A high-temperature separator material is necessary to prevent the outside layers, e.g., layers 22*a* and 22*d* in FIG. 1, from bonding to the platens of the hot press. Duofoil® (JJA, Inc.) was found suitable for use as a separator plate. Kapton KJ and EKJ films did not permanently adhere to Duofoil® after exposure to 300° C. and 1.4 MPa pressure. The platen separator should be cleaned (step 68) to avoid contamination of the polyimide. In experiments, the Duofoil® platen separator was cleaned with isopropanol. Placement of the polyimide layers on the platen separator (step 70) should be conducted with sufficient heat to avoid condensation on the layers. In experiments, an initial alignment of polyimide layers on Duofoil® sheets positioned on a flat hotplate at a constant temperature of 50–55° C. staved off condensation. The process is completed with placement of a second platen separator on top of the stack. Lamination is then conducted in a vacuum hot process.

Figure 4:
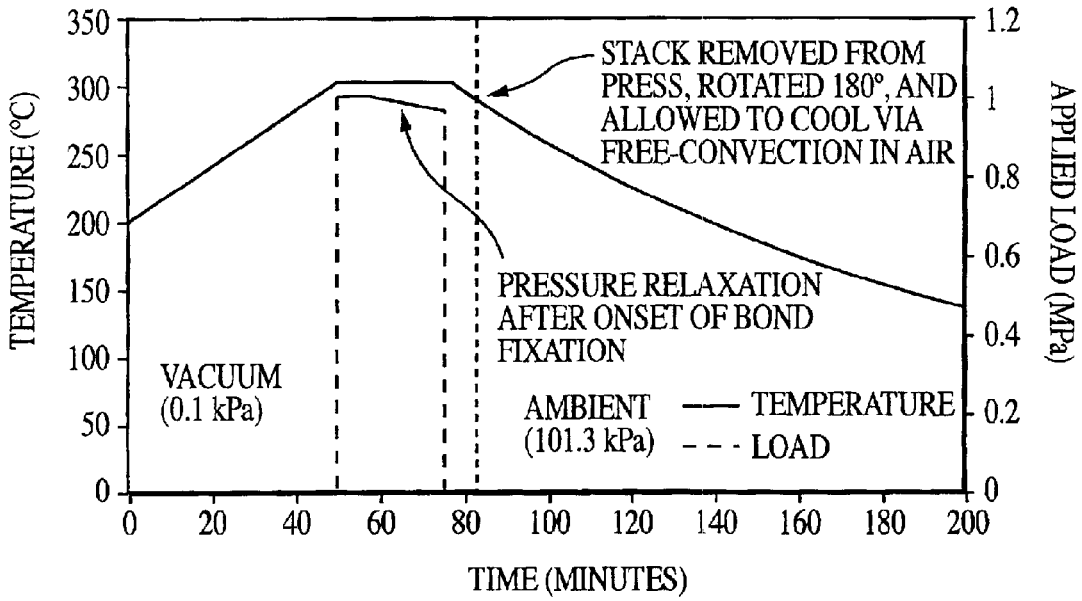
FIG. 4 shows the time, temperature, and applied pressure profile found to optimally bond layers in a laboratory conditions and style fabrication of a mesoscopic heat exchanger.

In experiments, a second Duofoil® plate was positioned on the four aligned polyimide layers, and the entire stack was sandwiched between two 160 mm×160 mm square aluminum plates, 25 mm thick. The aluminum block was then positioned on center in a modified Carver vacuum hot press at a standby temperature of 200° C. FIG. 4 shows the time, temperature, and applied pressure profile found to optimally bond the layers together. A pressure of 0.1 KPa was achieved in the press chamber and the press temperature was ramped to 300° C. at a rate of 2° C./min. Once 300° C. was reached, the hydraulic jack was used to apply a pressure of approximately 1 MPa for 25 minutes. Some pressure relaxation occurs during lamination, and no controls were initiated to maintain a constant load. After the 25 minutes had elapsed, the load was disengaged and the aluminum block was removed.

A cooling of the laminated heat compressor (step 72) preferably includes an inversion of the structure after removal from the vacuum process. In the experiments, the aluminum blocks were removed, flipped over, placed on a flat cast iron base, and allowed to cool to room temperature over a period of two hours. Rotation of the blocks switched the orientation of the films contained within the stack, thus reversing any previously acquired sagging in the header and channel layers during the initial phase of the cool-down process. The block cools via conduction to the cast iron base or by natural convection to the surrounding air. As such, the aluminum blocks provided the thermal mass which self-controlled the cooling process.

Several different uniformly bonded (no interlaminar voids or bubbles), functional 100 mm×100 mm footprint, prototype heat exchangers according to the FIGS. 1 and 2 embodiment were fabricated. The description of prototypes is included here only as an example, and the invention is not limited to the materials, dimensions or geometry of the prototypes. Empirical studies of each implemented design iteration yielded various critical fabrication parameters.

During the lamination process, excessive thermoplastic flow of material in layers adjacent (above or below) to a local internal geometry can easily occlude both channels and manifolds which have micron scaled dimensions. Therefore, the most critical design parameter underlying the four-layer lamination methodology for creation of internal geometries was a material dependent, maximum allowable membrane span. For EKJ films, membrane spans up to 2 mm are allowed because of the presence of a stiff Kapton® E core with a higher apparent glass transition temperature. The maximum membrane span of KJ films are considerably less, probably closer to 500 $\mu$m.

In the fabrication of experimental prototypes, channel dimensions were targeted at 75 $\mu$m high×800 $\mu$m wide. However, some compression of these dimensions was noticed subsequent to lamination, resulting in approximate channel dimensions of 70 $\mu$m×750 $\mu$m. Over numerous cross-sections, no discernable interface existed between the internal KJ layers (2 & 3) after bonding, direct evidence of diffuse, thermoplastic polymer welding. Moreover, plastic flow of these layers was observed in the narrowing channel width, or widening of the channel separators, towards the bottom of the channel. In qualitative strength tests, KJ/KJ welded interfaces demonstrated the highest observed bond strengths. However, because of the aforementioned sagging criterion, an all-KJ, four layer proved unfeasible.

Accordingly, the sequencing of EKJ and KJ films within the laminate mesoscopic heat exchanger is not an arbitrary design parameter. From this, the invention should be carried out with outer layers having a modulus and glass transition temperature to withstand lamination with thermoplastic flow and inner layers that permit limited thermoplastic flow that maintains microchannel shape during lamination. Channel dimensions can be selected depending on the application. Thinner channels than those tested in the experimental prototypes can be used if shorter channel lengths are employed, and vice versa. Moreover, the span width can be adjusted with respect to the cap layer thickness to determine how much sagging is desired. In fact, under pressure, the channel height effectively becomes larger due to expansion of the cap layer, which permits a higher flow rate. This phenomenon helps to self-regulate the pressure drop in the channels and is a benefit of the invention.

The fabrication method of the invention, such as the preferred method of FIG. 3, will lend itself into a mass production conducted, for example, on a moving web machine. Each layer is a separate feed into the web, with a cutting and patterning station to make its pattern. Conditions are maintained to laminate the layers after patterning while moving on the moving web.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A flexible microchannel heat exchanger, comprising:

a device interface layer including inlet and outlet holes and being formed from a first heat-sealable polyimide material;

a header layer formed from a second heat-sealable polyimide material and heat-sealed to said device interface layer, said header layer including ports aligned with said inlet and outlet holes and fluid distribution microchannels in fluid communication with said ports;

a channel layer formed from said second heat-sealable polyimide material and heat-sealed to said header layer, said channel layer including fluid flow microchannels in fluid communication with said fluid distribution channels and oriented differently than said fluid distribution channels; and a cap layer formed from said first heat-sealable polyimide material and heat sealed to said channel layer.

2. The heat exchanger of claim 1, wherein said first heat-sealable polyimide material has a greater glass transition temperature than said second heat-sealable polyimide material.

3. The heat exchanger of claim 2, wherein said first heat-sealable polyimide material includes a core having said greater glass transition temperature.

4. The heat exchanger of claim 1, wherein:

said first heat-sealable polyimide material is DuPont Kapton® EKJ; and said second heat sealable polyimide material is DuPont Kapton® KJ.

5. The heat exchanger of claim 1, wherein the microchannels in said channel layer have a plurality of lengths.

6. The heat exchanger of claim 5, wherein the microchannels in said channel layer have an overall hourglass-like shape, and a waist of the hourglass-like shape aligns with said ports in said header layer.

7. The heat exchanger of claim 1, wherein fluid communication between microchannels in said header layer and said channel layer is established where ends of microchannels in said channel layer intersect microchannels in said header layer.

8. The heat exchanger of claim 7, wherein microchannels or sets of microchannels in said channel layer further from said ports intersect more microchannels in said header layer than microchannels or sets of microchannels in said channel layer that are closer to said ports.

9. The heat exchanger of claim 1, wherein said header and channel layers are thicker than said device interface and cap layers.

10. A flexible microchannel heat exchanger, comprising:

a laminated polyimide structure including a device interface layer, a header layer, a channel layer and a cap layer; and a three-dimensional microchannel fluid circuit formed by microchannels in said header layer and said channel layer and holes in said device interface layer, wherein intersections of microchannels between said header layer and said channel layer define flow paths between said header layer and said channel layer.

11. The heat exchanger of claim 10, wherein microchannels or sets of microchannels in said channel layer further from said holes intersect more microchannels in said header layer than microchannels or sets of microchannels in said channel layer that are closer to said holes.

* * * * *